US011523723B2

(12) United States Patent
Pope

(10) Patent No.: US 11,523,723 B2
(45) Date of Patent: Dec. 13, 2022

(54) POLISHING MACHINE

(71) Applicant: Refuse Materials, Inc., Ocilla, GA (US)

(72) Inventor: Donald A. Pope, Ocilla, GA (US)

( * ) Notice: Subject to any disclaimer, the term of this patent is extended or adjusted under 35 U.S.C. 154(b) by 119 days.

(21) Appl. No.: 16/817,244

(22) Filed: Mar. 12, 2020

(65) Prior Publication Data

US 2020/0288933 A1 Sep. 17, 2020

Related U.S. Application Data

(60) Provisional application No. 62/816,911, filed on Mar. 12, 2019.

(51) Int. Cl.
*A47L 11/206* (2006.01)
*A47L 11/40* (2006.01)

(52) U.S. Cl.
CPC ..... *A47L 11/206* (2013.01); *A47L 11/4038* (2013.01); *A47L 11/4044* (2013.01); *A47L 11/4069* (2013.01)

(58) Field of Classification Search
CPC ..... B24B 7/18; B24B 7/186; B24B 55/12; B24B 57/00; B24B 57/02; B24B 57/04; B24C 3/06; B24C 3/065; B24C 3/067
See application file for complete search history.

(56) References Cited

U.S. PATENT DOCUMENTS 4,096,084 A 6/1978 Thomsen et al.
4,128,756 A * 12/1978 Nagano ..... G03G 21/02 377/39
4,138,756 A 2/1979 Krier
4,334,335 A 6/1982 Brown et al.
4,633,541 A 1/1987 Block
4,817,233 A * 4/1989 Waldhauser ..... A47L 11/30 15/320
6,023,813 A 2/2000 Thatcher et al.
6,152,805 A 11/2000 Takahashi
(Continued)

FOREIGN PATENT DOCUMENTS

CA 2537720 A1 7/2007
WO 2006036143 A1 4/2006

OTHER PUBLICATIONS

Concrete Construction, Ride-on Grinder, Feb. 10, 2017, https://www.concreteconstruction.net/products/decorative-concrete-surfaces/ride-on-grinder_o (Year: 2017).*
(Continued)

*Primary Examiner* — Joel D Crandall
(74) *Attorney, Agent, or Firm* — Brian Bellamy

(57) ABSTRACT

A floor polishing machine for concrete includes a frame with an integrated hydraulic fluid tank, a hydraulic drive system, and a hydraulic pump vacuum system. Further, the machine provides a swivel polishing head that provides abutting contact with a floor and includes a floating ring and rubber skirts that seals the polishing head. The machine provides interchangeable wet and dry vacuum systems for collection of the slurry during wet operation and dust during dry operation. A support member inserts into a receiving sleeve for a choice of wet or dry option. A squeegee system attached to the rear of the apparatus collects slurry and operates to send the slurry to a collection tank. The squeegee lifts out of the way during dry operation.

5 Claims, 14 Drawing Sheets

(56) References Cited

U.S. PATENT DOCUMENTS

| | | | | |
|---|---|---|---|---|
| 7,448,114 | B2 | 11/2008 | Basham et al. | |
| 7,640,622 | B2 | 1/2010 | Vankouwenberg | |
| 9,272,383 | B1 | 3/2016 | Dickson | |
| 2005/0235453 | A1* | 10/2005 | Vankouwenberg | A47L 11/4044 15/340.4 |
| 2006/0282975 | A1 | 12/2006 | Basham et al. | |
| 2007/0155285 | A1* | 7/2007 | Padgett | B24B 55/06 451/5 |
| 2014/0130292 | A1* | 5/2014 | Pedlar | A47L 11/4027 15/320 |

OTHER PUBLICATIONS

Concrete Floor Polishing Machine Driving on Polisher https://merrock.en.made-inchina.com/product/YXHEaPjwCFkx/China-Concrete-Floor-Polishing-Machine-Drivingon-Polisher.html XTREMA—Industrial Floor Sweeper https://www.eurekasweepers.com/en/floorsweepers/xtrema.html.

* cited by examiner

POLISHING MACHINE

PRIORITY CLAIM

This application claims benefit of U.S. provisional patent application No. 62/816,911 filed on Mar. 12, 2019.

TECHNICAL FIELD

The present invention relates to floor polishing machines and, particularly, to a polishing machine for concrete floors with integrated systems for collecting dust and sludge while operating safely indoors.

BACKGROUND

The object of the present invention is to provide the floor polishing machine suited for concrete floors that solve problems in the prior art with labor and air quality.

Concrete floors in large commercial buildings are typical, but in the absence of concrete floor polishing these floors are neither beautiful nor healthy. Unclean concrete floors give buildings a very cheap feel, so a polished concrete floor is necessary. A specific, concrete floor polishing machine relieves work intensity and improve grinding efficiency, but in the current market existing concrete floor sander disc has limitations and cannot be widely used in different places of the concrete floor for environmental concerns. A need exists for a concrete floor polishing machine that reduces labor and provides for a safe environment free from air pollution and dangerous gases.

SUMMARY OF THE INVENTION

According to the embodiments illustrated herein, there is provided a polishing machine for concrete floors. The polishing machine comprises a frame comprising one or more holes to mount an integrated tank for holding hydraulic fluid, a vacuum canister and a slurry fluid collection tank. The polishing machine further comprises a hydraulic pump comprising a piggyback pump to drive a vacuum pump to generate suction for collection of dust or slurry. The polishing machine further comprises a support member connected to a receiving bracket of the frame. In an embodiment, the support member provides a structure for mounting the vacuum canister, the slurry fluid collection tank, and a dust collection bag. The polishing machine further comprises a first vacuum hose connected between the vacuum pump and the dust collection bag. In an embodiment, during dry operation the vacuum pump creates suction and dust is directed to the dust collection bag via the first vacuum hose. The polishing machine further comprises a second vacuum hose connected between a squeegee and the slurry fluid collection tank. In an embodiment, during wet operation the vacuum pump creates suction and slurry is directed to the slurry fluid collection tank via the second vacuum hose. In an embodiment, the squeegee connects to the polishing machine via a swivel on a pivot pin whereby the squeegee remains in contact with concrete floors during polishing. In an embodiment, the squeegee controls the slurry through combination of a brush that collects the slurry and the second vacuum hose built into the squeegee that vacuums the slurry into the slurry fluid collection tank.

The present invention provides a combination of wet and dry polishing machine that safely operates indoors using hydraulics—the hydraulically driven polisher using variable speed hydrostatic controls. The frame provides an integrated tank for holding hydraulic fluid and includes a female receiving bracket for integration of a vacuum canister or sludge tank systems. The hydraulic pump includes a piggyback pump that drives a vacuum pump. The vacuum pump provides suction for the collection of dust or sludge.

In a first configuration, the polishing machine provides a dust control vacuum. A support member inserts into a receiving bracket of the machine's frame. The support provides a structure for carrying the vacuum canister and dust collection bag. The vacuum hoses for the vacuum connection to the vacuum pump system, and the polishing operates dry. The integrated vacuum manages dust.

In a second configuration, the polishing machine provides for slurry control. A support member supports a slurry fluid collection tank—the support member inserts into the receiving bracket of the machine's frame. Vacuum hoses for the tank connect a squeegee system and a vacuum pump system. In this configuration, the polishing machine operates wet. The wet operation minimizes dust further and meets the need for stricter environmental controls. The two different configurations are swappable and allow both the wet and dry collection of dust to be built into the machine, thereby reducing labor.

The squeegee connects to the polishing machine via a swivel on a pivot pin whereby the squeegee remains flush with the floor during polishing, so this section is effective in removing all sludge from the floor. The squeegee controls the slurry through the combination of a brush that collects the slurry and a suction channel built into the squeegee that vacuums the slurry into the tank.

The polishing head mounts on a swivel for maintaining abutting contact with the floor. The head floats on the floor via the swivel, and a floating ring operates in combination with a rubber skirt attached to the ring. Thereby, the rubber skirt provides a seal about the polishing head. The rubber skirt seals to the floor and prevents dust or slurry from escaping other than through the preferred means.

These features and advantages of the present disclosure may be appreciated by reviewing the following description of the present disclosure, along with the accompanying figures wherein like reference numerals refer to like parts.

BRIEF DESCRIPTION OF DRAWINGS

The accompanying drawings illustrate the embodiments of systems, methods, and other aspects of the disclosure. Any person with ordinary skills in the art will appreciate that the illustrated element boundaries (e.g., boxes, groups of boxes, or other shapes) in the figures represent an example of the boundaries. In some examples, one element may be designed as multiple elements, or multiple elements may be designed as one element. In some examples, an element shown as an internal component of one element may be implemented as an external component in another, and vice versa. Furthermore, the elements may not be drawn to scale.

Various embodiments will hereinafter be described in accordance with the appended drawings, which are provided to illustrate, not limit, the scope, wherein similar designations denote similar elements, and in which.

DETAILED DESCRIPTION

Figure 1:
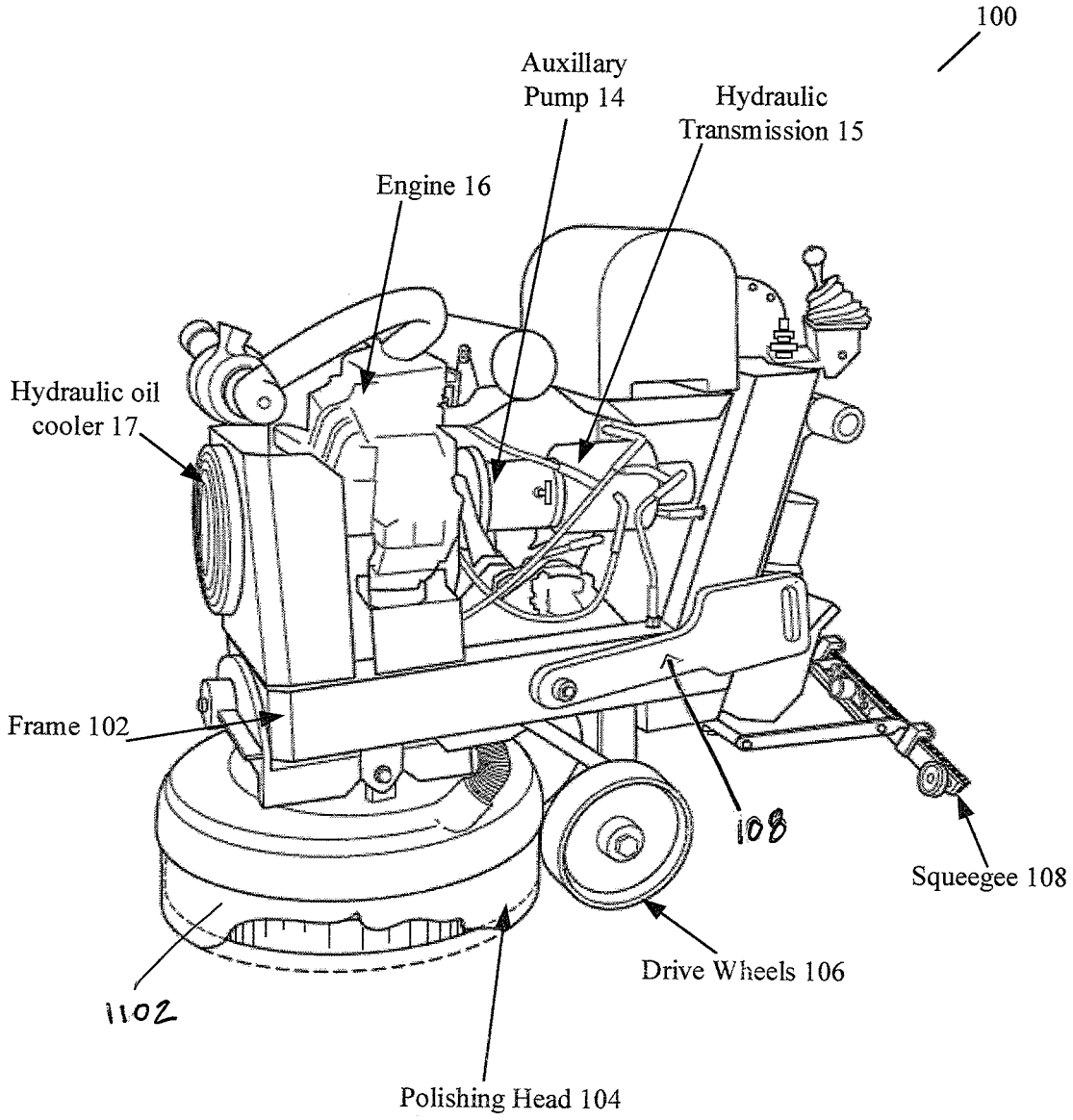
FIG. 1 is a front left-side perspective view of the polishing machine according to a preferred embodiment of the present invention.

The present disclosure is best understood with reference to the detailed figures and description set forth herein. Various embodiments have been discussed with reference to the figures. However, those skilled in the art will readily appreciate that the detailed descriptions provided herein with respect to the figures are merely for explanatory purposes, as the methods and systems may extend beyond the described embodiments. For instance, the teachings presented and the needs of a particular application may yield multiple alternative and suitable approaches to implement the functionality of any detail described herein. Therefore, any approach may extend beyond certain implementation choices in the following embodiments.

References to "one embodiment", "at least one embodiment", "an embodiment", "one example", "an example", "for example", and so on indicate that the embodiment(s) or example(s) may include a particular feature, structure, characteristic, property, element, or limitation, but not every embodiment or example necessarily includes that particular feature, structure, characteristic, property, element, or limitation. Furthermore, repeated use of the phrase "in an embodiment" does not necessarily refer to the same embodiment.

Unless defined otherwise, all technical and scientific terms used herein have the same meaning as commonly understood by one of the ordinary skills in the art to which this invention belongs. Although any method and material similar or equivalent to those described herein can also be used in the practice or testing of the present invention, the preferred methods and materials have been described. All publications, patents, and patent applications mentioned herein are incorporated in their entirety.

It is noted that as used herein and in the appended claims, the singular forms "a", "and", and "the" include plural referents, unless the context clearly dictates otherwise. In the claims, the terms "first", "second", and so forth are to be interpreted merely as ordinal designations; they shall not be limited in themselves. Furthermore, the use of exclusive terminology such as "solely", "only", and the like in connection with the recitation of any claim element is contemplated. It is also contemplated that any element indicated to be optional herein may be specifically excluded from a given claim by way of a "negative" limitation. Finally, it is contemplated that any optional feature of the inventive variation(s) described herein may be set forth and claimed independently or in combination with any one or more of the features described herein.

All references cited herein, including publications, patent applications, and patents, are hereby incorporated by reference to the same extent as if each reference were individually and specifically indicated to be incorporated by reference, and were set forth in its entirety herein.

The recitation of ranges of values herein is merely intended to serve as a shorthand method of referring individually to each separate value falling within the range, unless otherwise indicated herein, and each separate value is incorporated into the specification as if it were individually recited herein.

The disclosed and claimed invention herein provides a polishing machine for concrete floors. The polishing machine comprises a frame comprising one or more holes to mount an integrated tank for holding hydraulic fluid, a vacuum canister and a slurry fluid collection tank. The polishing machine further comprises a hydraulic pump comprising a piggyback pump to drive a vacuum pump to generate suction for collection of dust or slurry. The polishing machine further comprises a support member connected to a receiving bracket of the frame. In an embodiment, the support member provides a structure for mounting the vacuum canister, the slurry fluid collection tank, and a dust collection bag. The polishing machine further comprises a first vacuum hose connected between the vacuum pump and the dust collection bag. In an embodiment, during dry operation the vacuum pump creates suction and dust is directed to the dust collection bag via the first vacuum hose. The polishing machine further comprises a second vacuum hose connected between a squeegee and the slurry fluid collection tank. In an embodiment, during wet operation the vacuum pump creates suction and slurry is directed to the slurry fluid collection tank via the second vacuum hose. In an embodiment, the squeegee connects to the polishing machine via a swivel on a pivot pin whereby the squeegee remains in contact with concrete floors during polishing. In an embodiment, the squeegee controls the slurry through combination of a brush that collects the slurry and the second vacuum hose built into the squeegee that vacuums the slurry into the slurry fluid collection tank.

In an embodiment, the polishing head is mounted on a swivel for maintaining abutting contact with concrete floor. In an embodiment, the polishing head floats on the concrete floor via the swivel. In an embodiment, a floating ring that operates in combination with a rubber skirt attached to the floating ring, wherein the rubber skirt provides a seal about the polishing head. In an embodiment, the rubber skirt is attached to the floating ring. In an embodiment, a hydraulic drive system with an engine, a motor, drive wheels, weights, and an auxiliary hydraulic pump connected to the vacuum pump. In an embodiment, the weights fold downward and frontward to produce up to 750 pounds of pressure on the polishing head. In an embodiment, the squeegee attaches to rear of the polishing machine and folds up during dry operation.

Referring now to FIG. 1 100, the present invention provides the polishing machine 100 that safely operates indoors for refinishing concrete floors. As shown in FIG. 1

100, the polishing machine 100 includes a frame 102, a polishing head 104, squeegee 108, auxiliary pump 14, hydraulic transmission 15, engine 16, hydraulic oil cooler 17, hydraulic drive system with the engine, a motor, and drive wheels 106, weights 108, and the auxiliary hydraulic pump connected to a vacuum system. The polishing machine includes a sealed polishing head and uses a self-contained hydrostatic system to operate the drive system and the vacuum system. Further, the single apparatus of FIG. 1 100 incorporates the vacuum system, the hydraulics, propane fuel 806, and polishing head 104. The side weights 108 fold downward and frontward to produce up to 750 pounds of pressure on the polishing head.

The frame 102 comprises one or more holes that receive brackets to mount the integrated polishing head and squeegee. In configurations the frame holds a vacuum canister 406 or a slurry fluid collection tank 604. Further, the frame 102 comprises an enclosed storage body 112 providing a tank for holding hydraulic fluid. The frame contains and in-tank filter 4 through which hydraulic fluid is drawn into the hydraulic transmission intake line 1. In an embodiment, the hydraulic system comprises a piggyback auxiliary pump 14, in addition to the hydraulic pump transmission 15, to drive a vacuum system to generate suction for collection of dust or slurry. Further, the polishing machine 100 comprises a support member 408 connected to a receiving bracket 409 of the frame 102 and the support member provides a structure for mounting the vacuum canister 406, the slurry fluid collection tank 604, and a dust collection bag 404.

Figure 2:
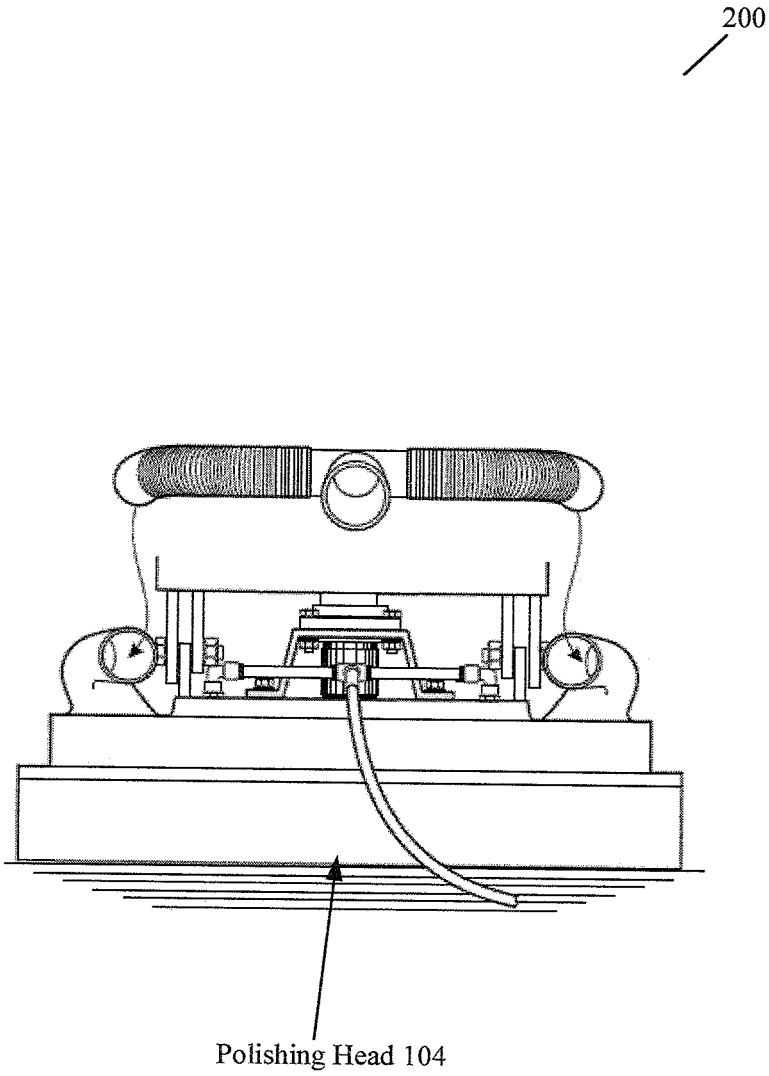
FIG. 2 is a front side view of the polishing head of the polishing machine.

FIG. 2 200 is a front side view of the polishing head 104 of the polishing machine. The polishing head is mounted on a latitudinal swivel 410 and longitudinal swivel 412 for maintaining abutting contact with concrete floor. The swivels each comprise an axle within a bearing member for rotation. The polishing head 104 floats on the concrete floor via the swivels, and a floating ring operates in combination with a rubber skirt attached to the ring. Thereby, the rubber skirt provides a seal about the polishing head. The rubber skirt seals to the floor and prevents dust or slurry from escaping other than through the preferred means.

Figure 3:
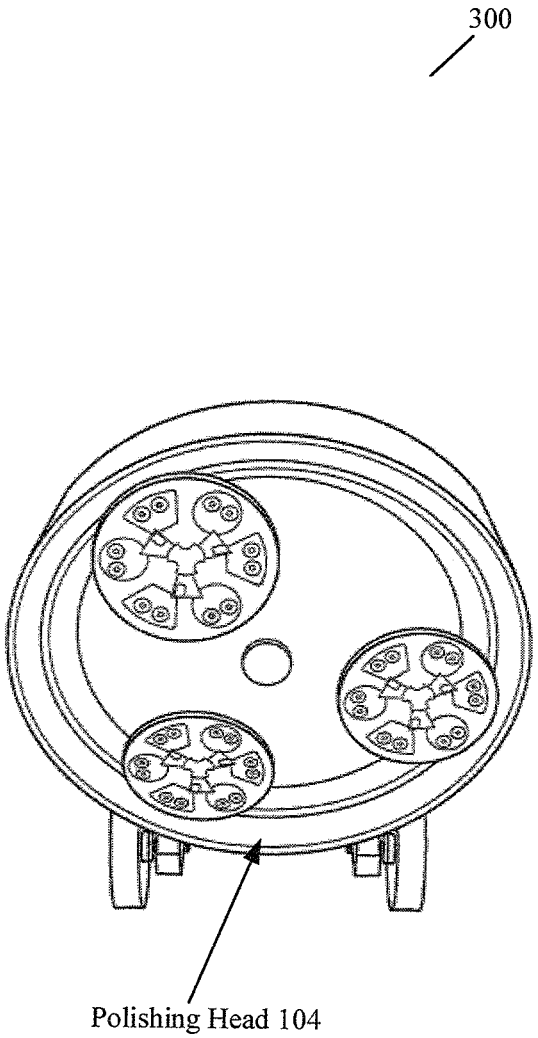
FIG. 3 illustrates the polishing means connected under the polishing head of the polishing machine.

FIG. 3 illustrates the polishing means connected under the polishing head 104 of the polishing machine. FIG. 3 specifically shows how the polishing means may move when connected via the swivel and the FIG. 3 also shows the polishing means used for concrete polishing.

Figure 4:
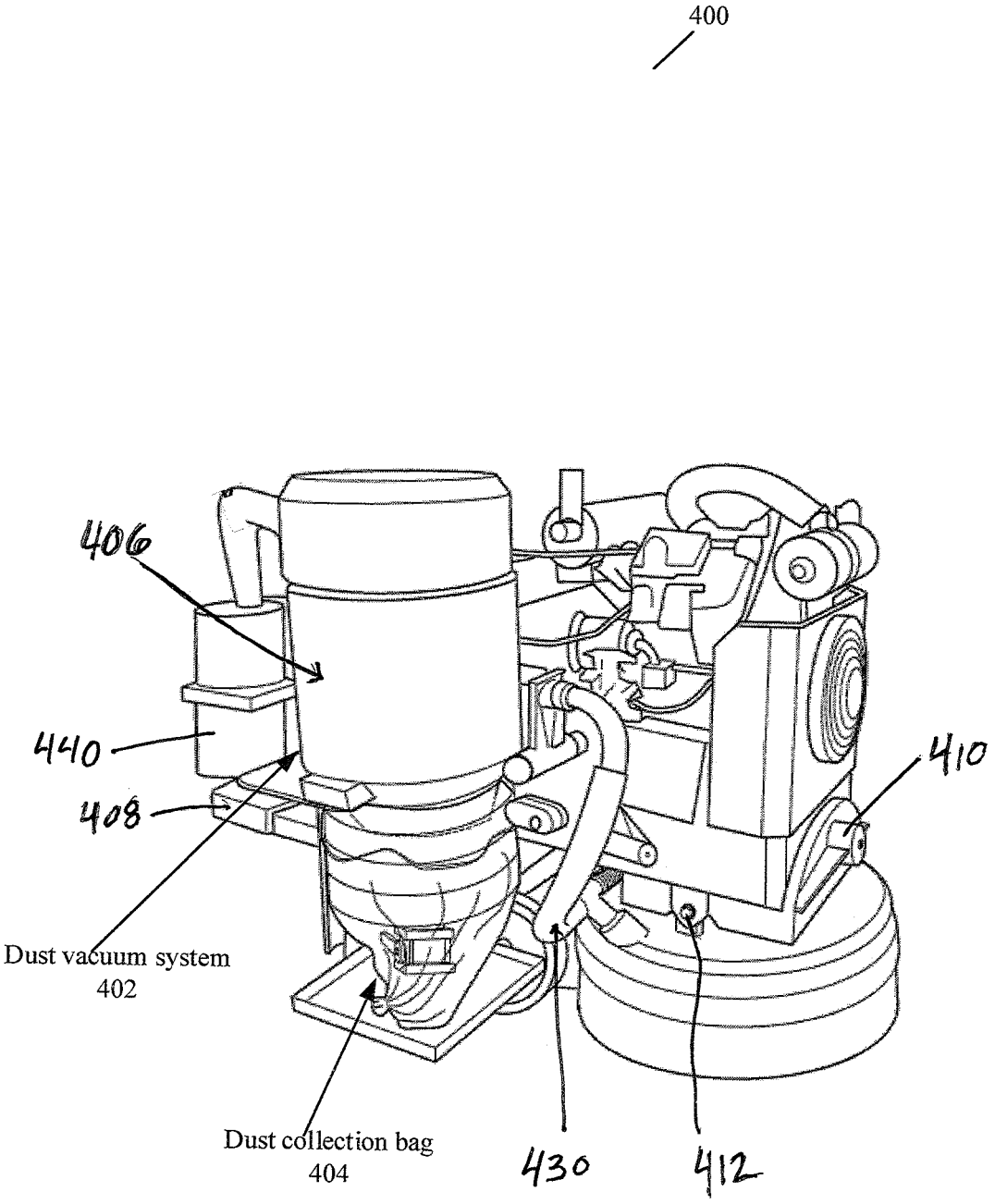
FIG. 4 is a front right-side perspective view of an embodiment of the polishing machine configured with a dust vacuum and dust collection bagging system.
Figure 5:
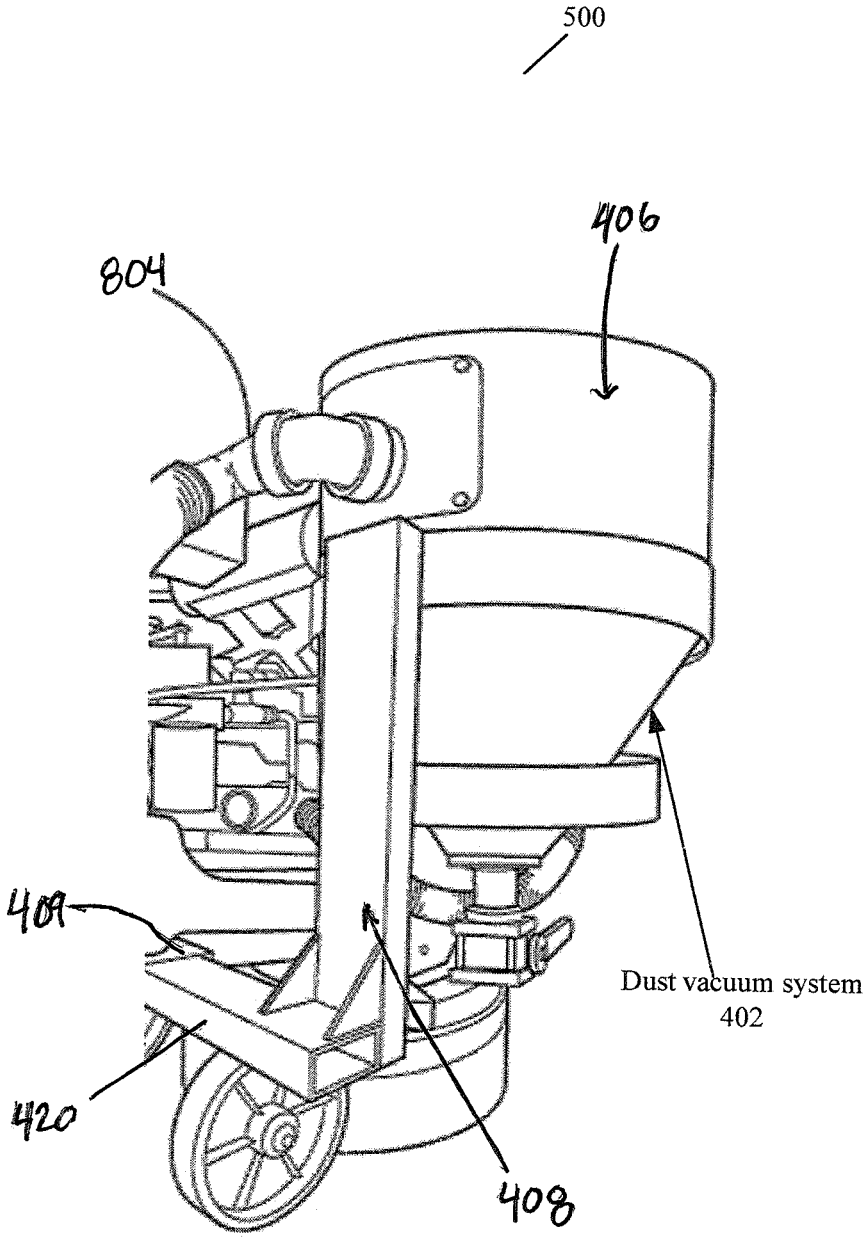
FIG. 5 is an enlarged right side view of the polishing machine configured with the dust vacuum system.

FIG. 4 is a front right-side perspective view of an embodiment of the polishing machine configured with a dust vacuum and dust collection bagging system. FIG. 5 is an enlarged right side view of the polishing machine configured with the dust vacuum system. FIGS. 4-5 400 and 500 illustrate a configuration of the apparatus with a dry vacuum system installed. Specifically, FIG. 4 shows a dust vacuum system 402 and the dust collection bag 404. And, specifically, FIG. 5 shows the receiving tube 409 integrated into the frame 102 for receiving a support member tube 420 attached to the support member 408.

Figure 6A:
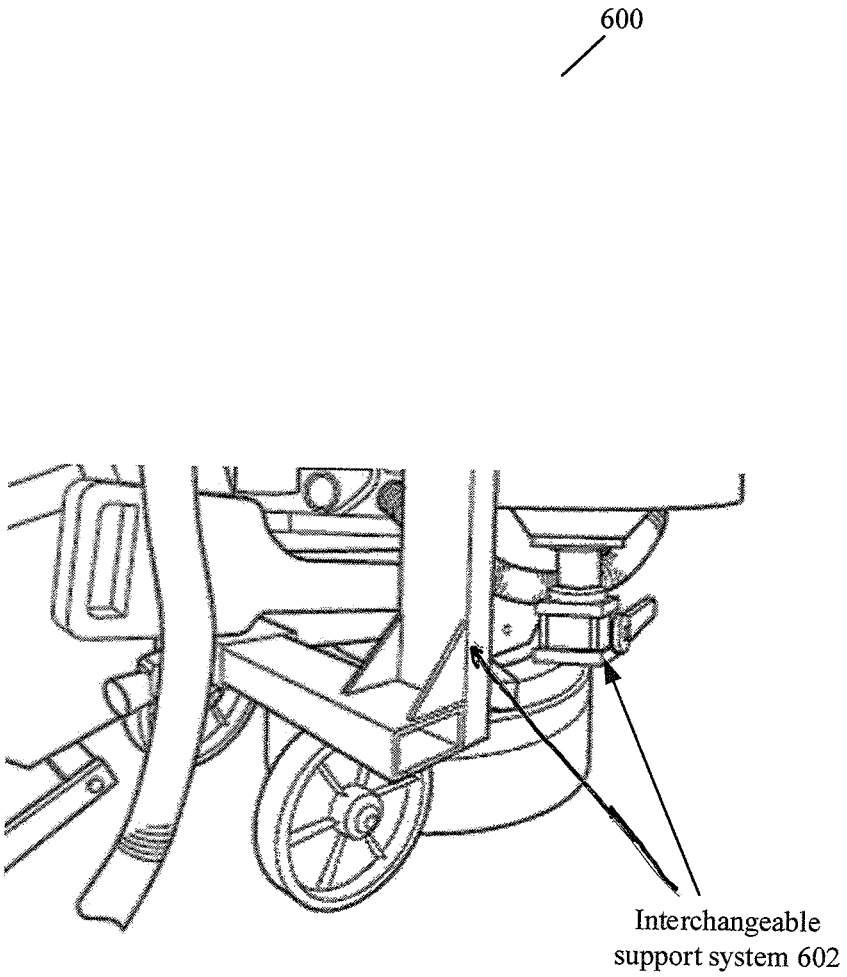
FIG. 6A is a bottom right-side perspective view of a receptacle of the polishing machine for an interchangeable dust vacuum system and slurry collection system.
Figure 6B:
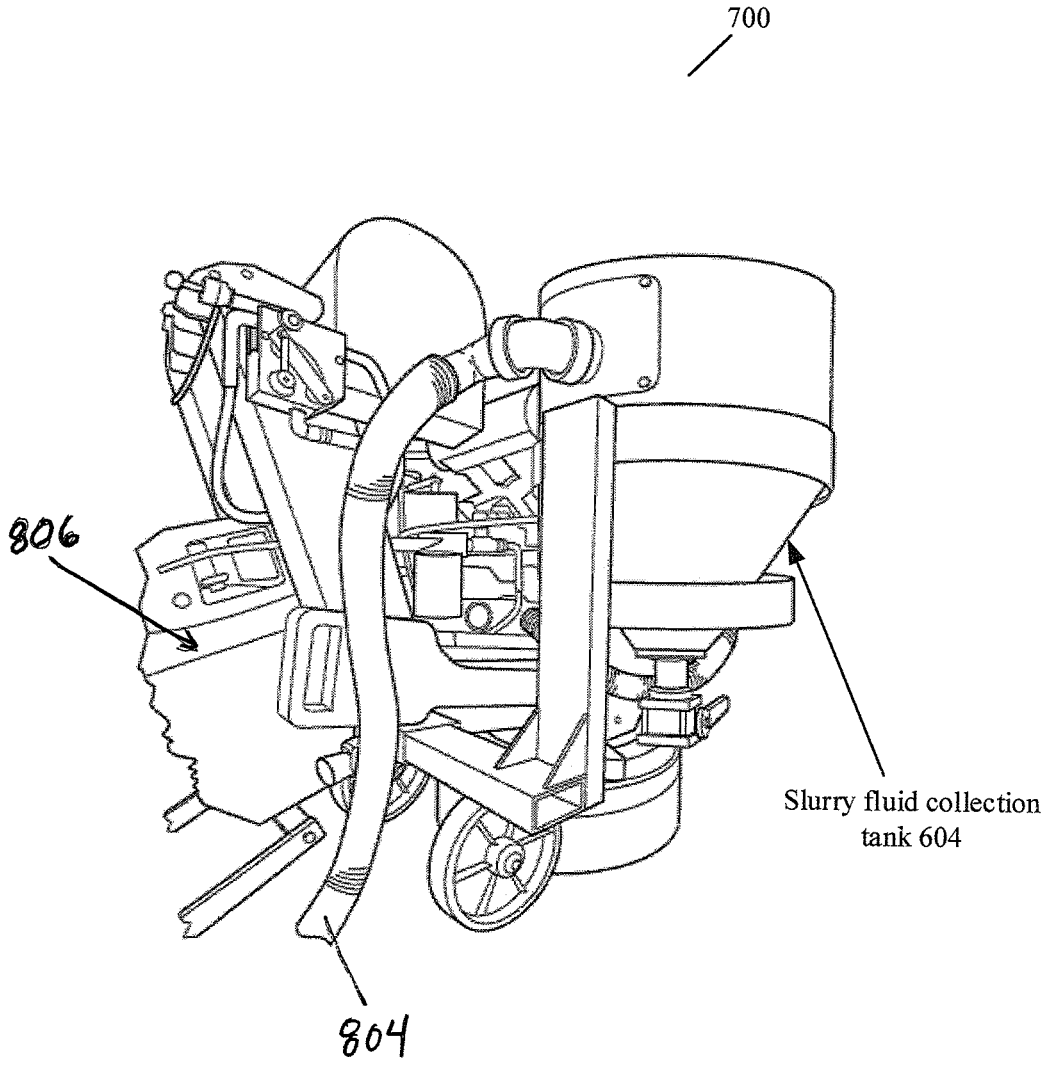
FIG. 6B is a rear right-side perspective view of the receptacle of FIG. 6A configured with the slurry collection system.

FIG. 6A is a bottom right-side perspective view of a receptacle of the polishing machine for an interchangeable dust vacuum system and slurry collection system and FIG. 6B is a rear right-side perspective view of the receptacle of FIG. 6A configured with the slurry collection system. Whereas, FIGS. 6A-6B 600, 700, show a second arrangement with a wet vacuum system attached. The polishing machine runs with a dry vacuum system that collects dust or a wet vacuum system that collects slurry. In a preferred method, the machine runs wet first. The wet steps provide coarse polishing grit that removed more material while producing more dust and sediment. The wet slurry prevents the increased dust from escaping vacuum when a dry vacuum system cannot keep up. A coarse grit produces more airborne particles that cause air pollution. At the end of the wet run, the operators roll a dry collection canister to the device and change the apparatus to the dry collection system to complete the job. The ability the current system provides to use a wet polishing system indoors substantially increases effectiveness.

The machine includes a system for interchanging the wet slurry collection tank with the dry dust collection canister and bag system. FIGS. 6A 600 shows the sleeve and attachment device of the interchangeable support system 602 in more detail. A support member provides an insertable carriage for the containers and support frame that is received by the receptacle sleeve of the machine's frame. The support insert slides out and detaches from the sleeve integrated into the frame of the machine. The wet system includes a water tank for slurry collection as shown in FIG. 6B which is the slurry fluid collection tank 604.

The dry system includes a vacuum with a canister and replaceable bags as shown in FIGS. 4-5 400 and 500. The bags comprise off-the-shelf supplies that attach to the canister. The bags are replaceable and pull off to save time. Once a bag is full and removed, another bag takes its place, and re-taping quickly seals the bag for further collection of dust. A first vacuum hose 430 is connected between the vacuum pump 440 and the dust collection bag 404, and during dry operation the vacuum pump creates suction and dust is directed to the dust collection bag via the first vacuum hose.

The prior art teaches standalone floor scrubbers with squeegees, but no concrete polishers that use a wet system or squeegee slurry collection system. Environmental regulations restrict dust indoors. As a result, dry concrete polishing is labor intensive, as a person follows any polishing attempt with a separate vacuum system to collect all dust. The combination wet/dry system shown in FIGS. 4-5 400 and 500 and FIGS. 6A-6B 600, and 700 saves labor by integrating these systems.

Figure 7A:
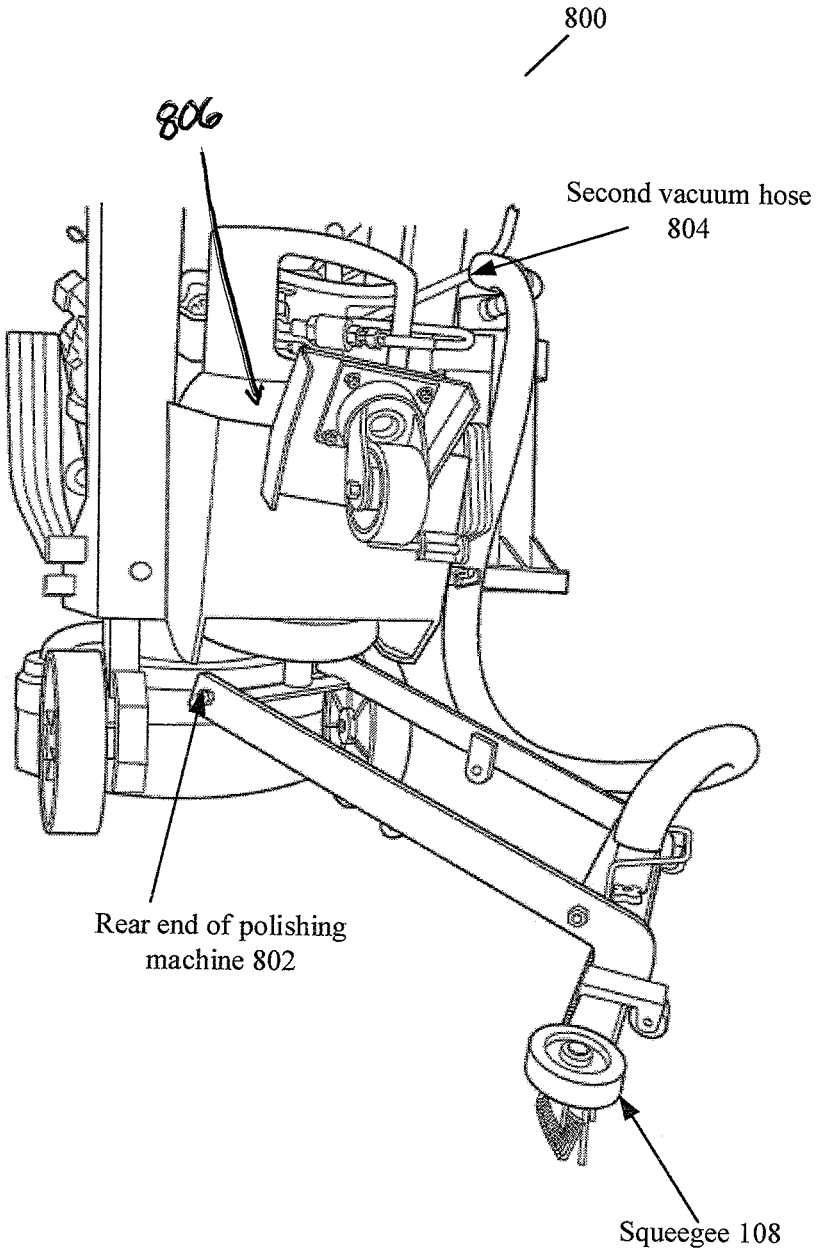
FIG. 7A is a rear view of the polishing machine configured with a squeegee system deployed in contact with a floor for slurry control.
Figure 7B:
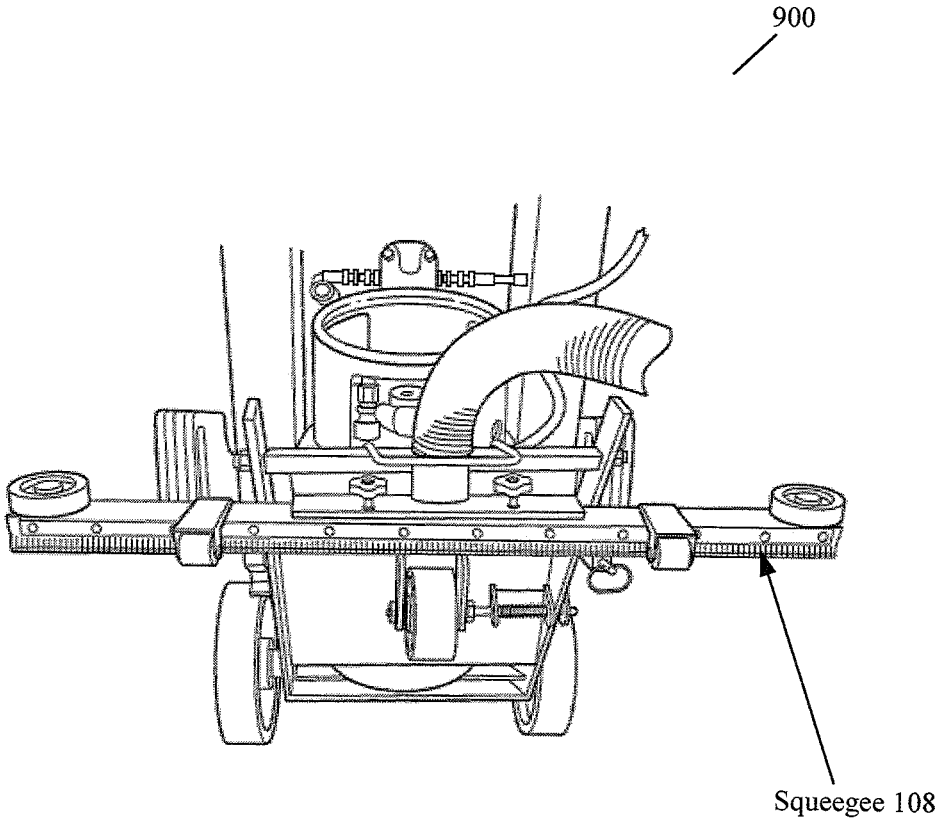
FIG. 7B is a rear view of the polishing machine configured with the squeegee system raised.
Figure 7C:
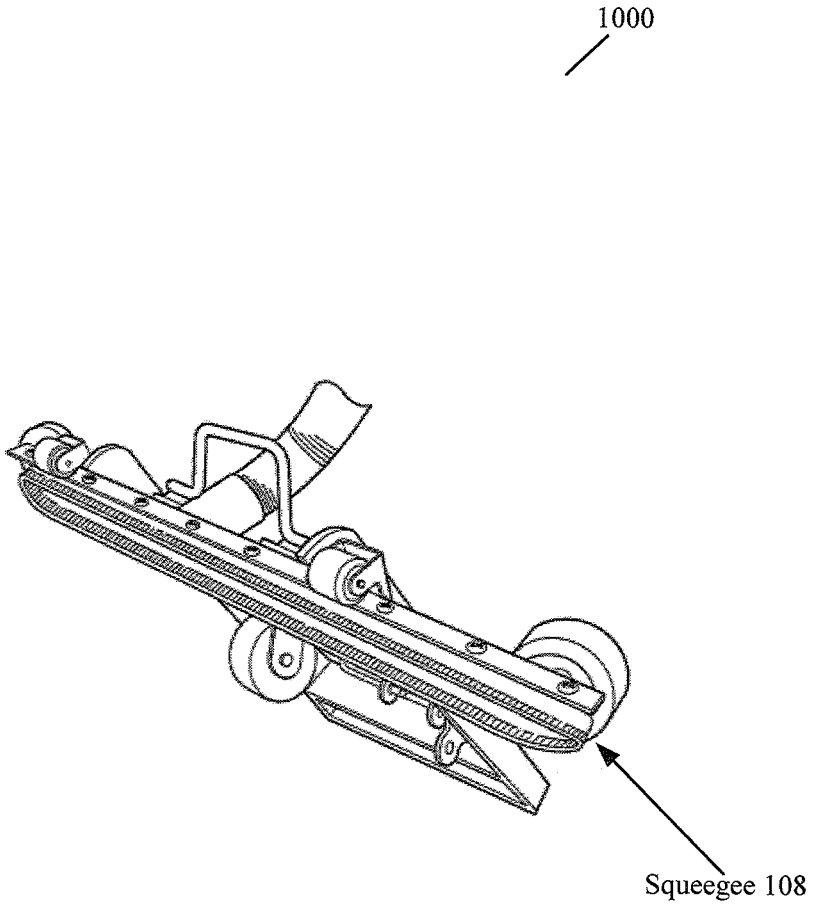
FIG. 7C is a sectional top view of the squeegee system deployed as in FIG. 7*a*.

FIG. 7A 800 is a rear view of the polishing machine configured with a squeegee system deployed in contact with a floor for slurry control. FIG. 7B 900 is a rear view of the polishing machine configured with the squeegee system raised. FIG. 7C 1000 is a sectional top view of the squeegee system deployed as in FIG. 7A. The squeegee 108 attaches to rear of the polishing machine 802 and folds up during dry operation.

In an embodiment, the polishing machine provides for slurry control. A support member supports a slurry fluid collection tank. The support member inserts into the receiving bracket of the machine's frame. Vacuum hoses for the tank connect a squeegee system and a vacuum pump system. The squeegee 108 connects to the polishing machine via a swivel on a pivot pin whereby the squeegee remains flush with the floor during polishing, so this section is effective in removing all sludge from the floor. The squeegee 108 controls the slurry through the combination of a brush that collects the slurry and a suction channel built into the squeegee that vacuums the slurry into the tank.

Thus, the second vacuum hose 804 that is connected between a squeegee 108 and the slurry fluid collection tank during wet operation creates suction and slurry is directed to the slurry fluid collection tank via the second vacuum hose. The squeegee 108 connects to the polishing machine via a swivel on a pivot pin whereby the squeegee remains in contact with concrete floors during polishing. The squeegee controls the slurry through combination of a brush that collects the slurry and the second vacuum hose built into the squeegee that vacuums the slurry into the slurry fluid collection tank.

Figure 8:
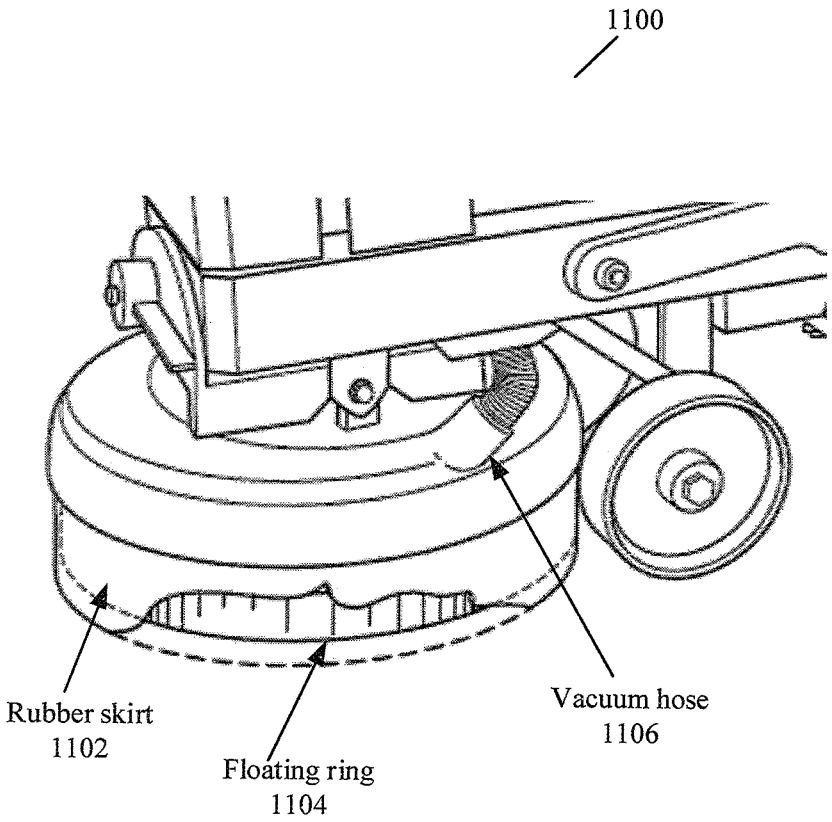
FIG. 8 is a sectional perspective view of a polishing head of the machine.

FIG. 8 1100 is a sectional perspective view of a polishing head 104 of the machine. The head 104 is attached to a pivot and swivels to remain flush with the floor surface. The head includes a rubber skirt 1102 that seals to an area about the polishing head 104 to the floor surface and prevents the escape of airborne particles. The rubber skirt 1102 attaches to a floating ring 1104. The ring 1104 sits about the circumference of the polishing head and rests freely for upward and downward movement. Whereby, the combination of the floating ring 1104 and rubber skirt 102 with the weight of the polishing head 104 present a rugged sealed polishing head that prevents airborne dust avoiding vacuum collection. A vacuum hose 1106 attaches to an opening in the top of the polishing head that vacuums and collects the dust.

Figure 9:
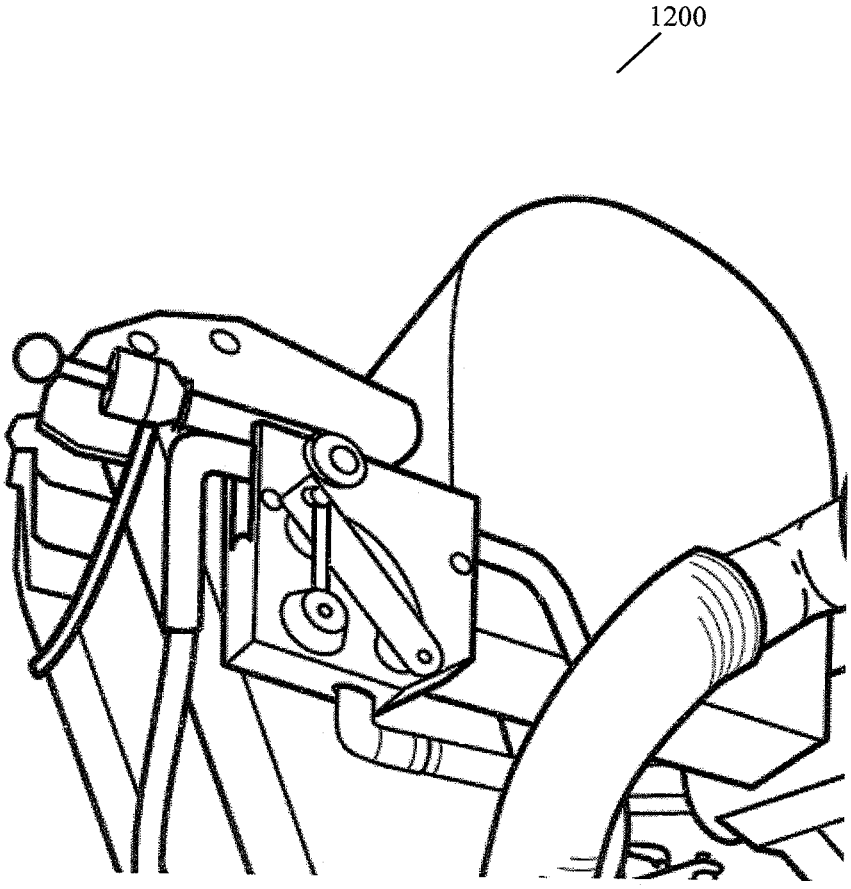
FIG. 9 shows the variable speed hydrostatic control for the hydraulic system of the apparatus.
Figure 10:
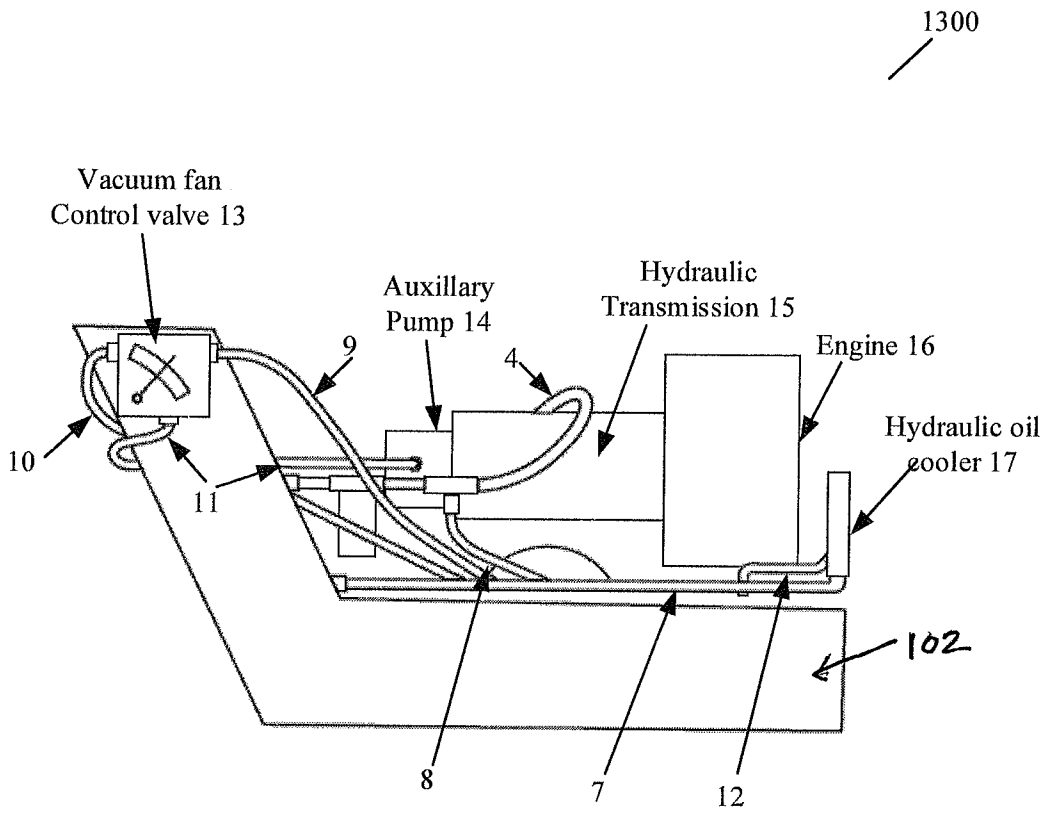
FIG. 10 is a right-side view of the hydrostatic system of the polishing machine.

FIG. 9 1200 shows the variable speed hydrostatic control for the hydraulic system of the apparatus. The hydraulic system controls the drive system and the vacuum system. The driver system operates from the main hydraulic pump, and the vacuum system operates from a secondary piggyback hydraulic pump. The hydraulic system shown in FIGS. 10-11 1300 and 1400 includes a frame containing hydraulic fluid, a hydraulic pump, an auxiliary pump 14, an engine 16, and a hydraulic transmission 15. The hydraulic system further includes a hydraulic transmission intake from an in-frame filter and an auxiliary pump intake line. The system includes a hydraulic transmission bypass to cooler through a check valve and a hydraulic transmission exhaust to in-line filter 4 for the return to the tank. And, the system includes a hydraulic transmission supply to the right side of the head motor and a hydraulic transmission supply to the left side of the head motor. The hydraulic system is a hydrostatic pump with a piggybacked pump that runs the vacuum which in turn runs the vacuum pump and thereby operates both the movement of the machine and the vacuum system. The hydrostatic pump operates the motor for driving the machine. Further, using a pulley and belt system to a turbine shaft of the vacuum the piggyback pump operates the vacuum pump FIG. 10 1300 is a right-side view of the hydrostatic system of the polishing machine. FIG. 10 1300 shows a hydraulic transmission exhaust to inline filter 4, return to tank from hydraulic oil cooler 7, vacuum motor exhaust to inline filter 8, vacuum control valve bypass to hydraulic oil cooler 9, vacuum motor supply line from vacuum control valve 10, auxiliary pump 14 to vacuum control valve 11, head bleed off to hydraulic oil cooler 12, a vacuum fan control valve 13, auxiliary pump 14, hydraulic transmission 15, an engine 16, a hydraulic oil cooler 17.

Figure 11:
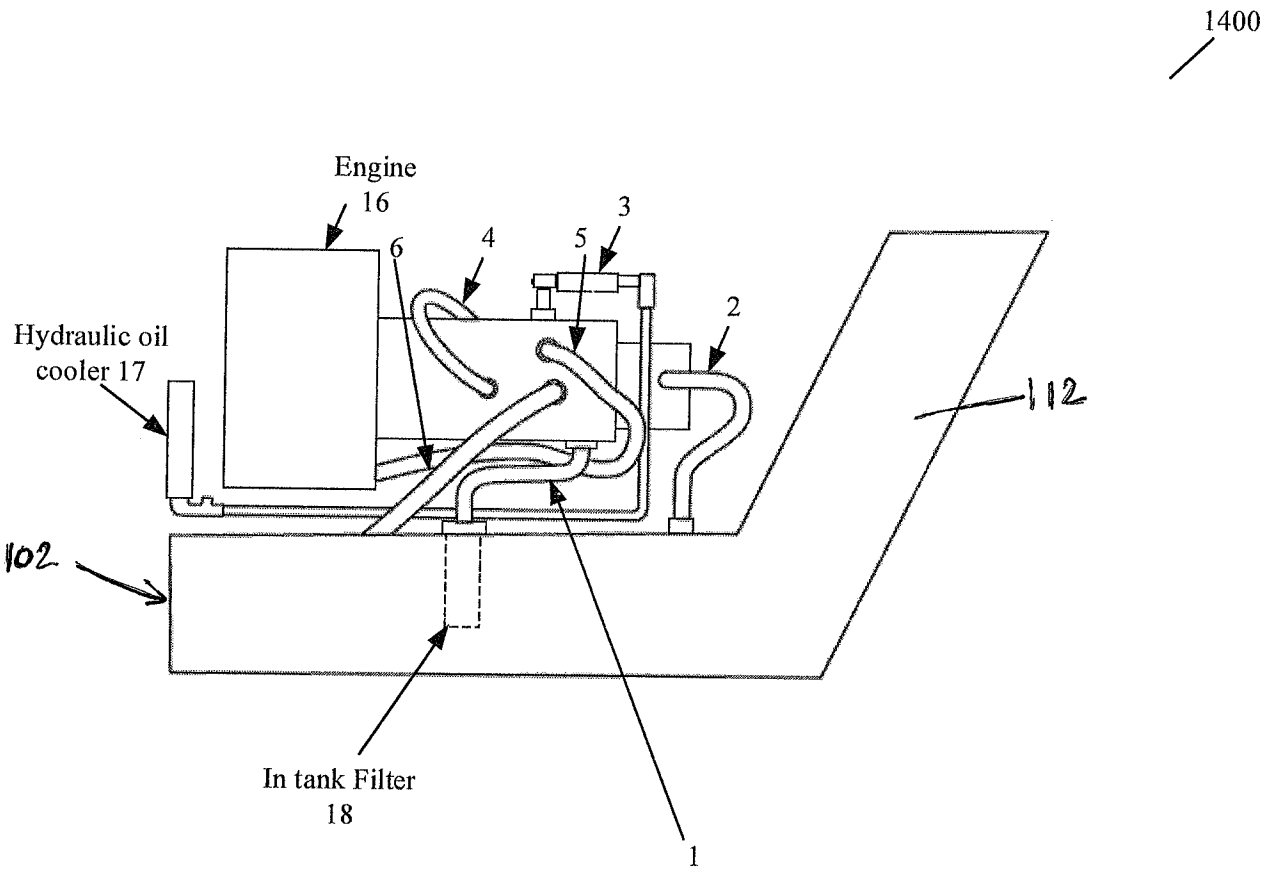
FIG. 11 is a left side view of the hydrostatic system of the polishing machine.

FIG. 11 1400 is a left side view of the hydrostatic system of the polishing machine. FIG. 11 1400 illustrates hydraulic transmission intake from in frame filter 1, auxiliary pump intake line 2, hydraulic transmission bypass to cooler through check valve 3, hydraulic transmission exhaust to inline filter/in tank filter (18) 4, hydraulic transmission supply to right side of head motor 5, and hydraulic transmission supply to left side of head motor 6, the engine 16, the hydraulic oil cooler 17.

The present invention provides a combination of wet and dry polishing machine that safely operates indoors using hydraulics. The hydraulically driven polisher uses variable speed hydrostatic controls. The frame provides an integrated tank for holding hydraulic fluid and includes a female receiving bracket for integration of a vacuum canister or sludge tank systems. The hydraulic pump includes a piggyback pump that drives a vacuum pump. The vacuum pump provides suction for the collection of dust or sludge.

In a first configuration, the polishing machine provides a dust control vacuum. A support member inserts into a receiving bracket of the machine's frame. The support provides a structure for carrying the vacuum canister and dust collection bag. The vacuum hoses for the vacuum connection to the vacuum pump system, and the polishing operates dry. The integrated vacuum manages dust.

In a second configuration, the polishing machine provides for slurry control. A support member supports a slurry fluid collection tank—the support member inserts into the receiving bracket of the machine's frame. Vacuum hoses for the tank connect a squeegee system and a vacuum pump system. In this configuration, the polishing machine operates wet. The wet operation minimizes dust further and meets the need for stricter environmental controls. The two different configurations are swappable and allow both the wet and dry collection of dust to be built into the machine, thereby reducing labor.

The squeegee connects to the polishing machine via a swivel on a pivot pin whereby the squeegee remains flush with the floor during polishing, so this section is effective in removing all sludge from the floor. The squeegee controls the slurry through the combination of a brush that collects the slurry and a suction channel built into the squeegee that vacuums the slurry into the tank.

The polishing head mounts on a swivel for maintaining abutting contact with the floor. The head floats on the floor via the swivel, and a floating ring operates in combination with a rubber skirt attached to the ring. Thereby, the rubber skirt provides a seal about the polishing head. The rubber skirt seals to the floor and prevents dust or slurry from escaping other than through the preferred means.

While the summary and detailed description show and describe preferred embodiments of the present invention, those skilled in the art recognize those embodiments as examples. The specification does not limit the invention by the specific examples provided. Instead, those skilled in the art recognize variations, changes, and substitutions without departing from the invention. Furthermore, all aspects of the invention are not limited to the specific depictions, configurations, or relative proportions set forth herein which depend upon a variety of conditions and variables. The inventor contemplates that the invention shall cover alternatives, modifications, variations, or equivalents.

ADVANTAGES

The disclosed polishing machine for concrete floors reduces labor and provides for a safe environment free from air pollution and dangerous gases. Further, the wet operation minimizes dust further and meets the need for stricter environmental controls. Additionally, the two different configurations are swappable and allow both the wet and dry collection of dust to be built into the machine, thereby reducing labor The terms "an embodiment", "embodiment", "embodiments", "the embodiment", "the embodiments", "one or more embodiments", "some embodiments", and "one embodiment" mean "one or more (but not all) embodiments of the invention(s)" unless expressly specified otherwise. The terms "including", "comprising", "having" and variations thereof mean "including but not limited to", unless expressly specified otherwise. The terms "a", "an" and "the" mean "one or more", unless expressly specified otherwise.

No language in the specification should be construed as indicating any non-claimed element as essential to the practice of the invention. A description of an embodiment with several components in communication with each other does not imply that all such components are required. On the contrary, a variety of optional components are described to illustrate the wide variety of possible embodiments of the invention.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based here on. Accordingly, the embodiments of the present invention are intended to be illustrative, but not limiting, of the scope of the invention, which is set forth in the following claims.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

A person with ordinary skills in the art will appreciate that the systems, components, and sub-components have been illustrated and explained to serve as examples and should not be considered limiting in any manner. It will be further appreciated that the variants of the above disclosed system elements, components, and sub-components, and other features and functions, or alternatives thereof, may be combined to create other different systems or applications.

Those skilled in the art will appreciate that any of the aforementioned steps and/or system modules may be suitably replaced, reordered, or removed, and additional steps and/or elements, components, and sub-components may be inserted, depending on the needs of a particular application.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

I claim:

1. A polishing machine for concrete floors, the polishing machine comprises:

a frame comprising one or more holes to mount an integrated tank for holding hydraulic fluid, a vacuum canister and a slurry fluid collection tank;

a hydraulic pump comprising a piggyback pump to drive a vacuum pump to generate suction for collection of dust or slurry;

a support member connected to a receiving bracket of the frame, wherein the support member provides a structure for mounting the vacuum canister, the slurry fluid collection tank, and a dust collection bag;

the vacuum canister with the dust collection bag includes the support member comprising a vacuum canister support member that interchangeably connects to a receiving bracket of the frame, and the slurry fluid collection tank includes the support member comprising a slurry fluid tank support member that interchangeably connects to a receiving bracket of the frame;

in a first configuration, said vacuum canister support member is inserted into the receiving bracket and provides a dust control vacuum;

in a second configuration, said slurry fluid tank support member is inserted into the receiving bracket of the frame and provides a slurry control vacuum;

said vacuum canister support member and said slurry fluid tank support member swap between the first configuration and the second configuration alternately collect said dust or slurry;

a first vacuum hose connected between the vacuum pump and the dust collection bag, wherein during dry operation the vacuum pump creates suction and dust is directed to the dust collection bag via the first vacuum hose; and a second vacuum hose connected between a squeegee and the slurry fluid collection tank, wherein during wet operation the vacuum pump creates suction and slurry is directed to the slurry fluid collection tank via the second vacuum hose, wherein the squeegee connects to the polishing machine via a first squeegee swivel on a pivot pin whereby the squeegee remains in contact with concrete floors during polishing, and wherein the squeegee controls the slurry through combination of a brush that collects the slurry and the second vacuum hose built into the squeegee that vacuums the slurry into the slurry fluid collection tank.

2. The polishing machine as claimed in claim 1 further comprises a polishing head mounted on a second polishing head swivel for maintaining abutting contact with concrete floor, wherein the polishing head floats on the concrete floor via the second polishing head swivel.

3. The polishing machine as claimed in claim 2 further comprises a floating ring that operates in combination with a rubber skirt attached to the floating ring, wherein the rubber skirt provides a seal about the polishing head, and wherein the rubber skirt is attached to the floating ring.

4. The polishing machine as claimed in claim 2 further comprises a hydraulic drive system with an engine, a motor, drive wheels, weights, and an auxiliary hydraulic pump connected to the vacuum pump, wherein the weights fold downward and frontward to produce up to 750 pounds of pressure on the polishing head.

5. The polishing machine as claimed in claim 1, wherein the squeegee attaches to rear of the polishing machine and folds up during dry operation.

* * * * *